US009228414B2

(12) United States Patent
Xu

(10) Patent No.: US 9,228,414 B2
(45) Date of Patent: Jan. 5, 2016

(54) JUNK BASKET WITH SELF CLEAN ASSEMBLY AND METHODS OF USING SAME

(71) Applicant: Baker Hughes Incorporated, Houston, TX (US)

(72) Inventor: Ying Qing Xu, Tomball, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 287 days.

(21) Appl. No.: 13/913,067

(22) Filed: Jun. 7, 2013

(65) Prior Publication Data

US 2014/0360725 A1 Dec. 11, 2014

(51) Int. Cl.

| | |
|---|---|
| ***E21B 37/08*** | (2006.01) |
| ***E21B 34/14*** | (2006.01) |
| *E21B 34/10* | (2006.01) |

(52) U.S. Cl.

CPC ..... *E21B 37/08* (2013.01); *E21B 34/14* (2013.01); *E21B 34/101* (2013.01)

(58) Field of Classification Search

CPC ..... E21B 37/08; E21B 27/00; E21B 27/005; E21B 34/14; E21B 34/101

See application file for complete search history.

(56) References Cited

U.S. PATENT DOCUMENTS

| | | | |
|---|---|---|---|
| 2,787,327 | A | 4/1957 | Pearson et al. |
| 2,894,725 | A | 7/1959 | Baker |
| 3,023,810 | A | 3/1962 | Anderson |
| 3,332,497 | A | 7/1967 | Page, Jr. |
| 3,360,048 | A | 12/1967 | Watkins |
| 3,500,933 | A | 3/1970 | Burba, Jr. et al. |
| 4,059,155 | A | 11/1977 | Greer |
| 4,217,966 | A | 8/1980 | Garrett |
| 4,276,931 | A | 7/1981 | Murray |
| 4,335,788 | A | 6/1982 | Murphey et al. |
| 4,390,064 | A | 6/1983 | Enen, Jr. et al. |
| 4,515,212 | A | 5/1985 | Krugh |
| 4,588,243 | A | 5/1986 | Ramsey et al. |

(Continued)

FOREIGN PATENT DOCUMENTS

| | | | |
|---|---|---|---|
| CN | 2883658 | Y | 3/2007 |
| GB | 2348226 | A | 9/2000 |

(Continued)

OTHER PUBLICATIONS

International Search Report and Written Opinion issued in International Application No. PCT/US2014/036817 dated Sep. 22, 2014.

(Continued)

*Primary Examiner* — Nicole Coy
*Assistant Examiner* — Tara Schimpf
(74) *Attorney, Agent, or Firm* — Parsons Behle & Latimer

(57) ABSTRACT

A downhole tool for removing debris from fluid flowing through the downhole tool comprises a screen member in sliding engagement with an inner wall surface of the tool. As the screen member becomes blocked, it moves from a first or initial position to a second or actuated position which causes a pressure change detectable at the surface of the wellbore. The pressure change causes the debris blocking fluid flow through the screen member to fall off the screen member thereby allowing an increase in fluid flow through the screen member. As a result, the screen member returns to its initial position and fluid again flows through the screen member for capturing by the screen member.

20 Claims, 3 Drawing Sheets

(56) References Cited

U.S. PATENT DOCUMENTS

| | | | | |
|---|---|---|---|---|
| 4,828,026 | A | 5/1989 | Nelson | |
| 4,857,175 | A | 8/1989 | Spinnler | |
| 4,880,059 | A | 11/1989 | Brandell et al. | |
| 5,228,518 | A | 7/1993 | Wilson et al. | |
| 5,425,424 | A | 6/1995 | Reinhardt et al. | |
| 5,524,709 | A | 6/1996 | Withers | |
| 5,533,373 | A | 7/1996 | Plester | |
| 6,112,812 | A | 9/2000 | Carter | |
| 6,176,311 | B1 * | 1/2001 | Ryan | 166/99 |
| 6,179,057 | B1 | 1/2001 | Fontana et al. | |
| 6,202,752 | B1 | 3/2001 | Kuck et al. | |
| 6,276,452 | B1 | 8/2001 | Davis et al. | |
| 6,341,653 | B1 | 1/2002 | Firmaniuk et al. | |
| 6,352,129 | B1 | 3/2002 | Best | |
| 6,361,272 | B1 | 3/2002 | Bassett | |
| 6,397,959 | B1 | 6/2002 | Villarreal | |
| 6,427,776 | B1 | 8/2002 | Hoffman et al. | |
| 6,446,737 | B1 | 9/2002 | Fontana et al. | |
| 6,543,538 | B2 | 4/2003 | Tolman et al. | |
| 6,568,475 | B1 | 5/2003 | Grubb et al. | |
| 6,607,031 | B2 | 8/2003 | Lynde et al. | |
| 6,655,459 | B2 | 12/2003 | Mackay | |
| 6,719,071 | B1 | 4/2004 | Moyes | |
| 6,755,256 | B2 | 6/2004 | Murley et al. | |
| 6,951,251 | B2 | 10/2005 | Penisson | |
| 7,069,992 | B2 | 7/2006 | Lewis et al. | |
| 7,096,975 | B2 | 8/2006 | Aronstam et al. | |
| 7,114,581 | B2 | 10/2006 | Aronstam et al. | |
| 7,174,975 | B2 | 2/2007 | Krueger et al. | |
| 7,267,172 | B2 | 9/2007 | Hofman | |
| 7,478,687 | B2 | 1/2009 | Lynde et al. | |
| 7,497,260 | B2 | 3/2009 | Telfer | |
| 7,513,303 | B2 | 4/2009 | Hern | |
| 7,610,957 | B2 | 11/2009 | Davis et al. | |
| 7,721,822 | B2 | 5/2010 | Krueger et al. | |
| 7,753,113 | B1 | 7/2010 | Penisson | |
| 7,806,203 | B2 | 10/2010 | Krueger et al. | |
| 7,861,772 | B2 | 1/2011 | Blair | |
| 7,987,901 | B2 | 8/2011 | Krueger et al. | |
| 8,011,450 | B2 | 9/2011 | Krueger et al. | |
| 8,225,859 | B1 * | 7/2012 | Moidel et al. | 166/99 |
| 2001/0050185 | A1 | 12/2001 | Calder et al. | |
| 2002/0079104 | A1 | 6/2002 | Garcie et al. | |
| 2003/0098181 | A1 | 5/2003 | Aronstam et al. | |
| 2004/0251033 | A1 | 12/2004 | Cameron et al. | |
| 2005/0061508 | A1 | 3/2005 | Surjaatmadja | |
| 2007/0272404 | A1 * | 11/2007 | Lynde et al. | 166/99 |
| 2010/0243258 | A1 | 9/2010 | Fishbeck et al. | |
| 2011/0024119 | A1 | 2/2011 | Wolf et al. | |
| 2011/0203848 | A1 | 8/2011 | Krueger et al. | |
| 2011/0253376 | A1 | 10/2011 | Krpec | |
| 2012/0152522 | A1 | 6/2012 | Lynde | |
| 2012/0160503 | A1 | 6/2012 | Davis | |
| 2013/0168091 | A1 | 7/2013 | Xu et al. | |

FOREIGN PATENT DOCUMENTS

| | | |
|---|---|---|
| WO | WO 99/22112 | 5/1999 |
| WO | WO 00/04269 | 1/2000 |
| WO | WO 00/08295 | 2/2000 |
| WO | WO 03/006778 A1 | 1/2003 |
| WO | WO 03/025336 A1 | 3/2003 |

OTHER PUBLICATIONS

Don M. Hannegan, et al., Technologies Manage Well Pressures, The American Oil & Gas Reporter, Sep. 2001, pp. 87-93, National Publishers Group Inc., U.S.A.

Anthony Hill and William Furlow, New Tool Addresses ECD Problem, Offshore, Jun. 2002, pp. 88-89, U.S.A., copy retrieved May 14, 2012, from http://www.pennenergy.com/index/petroleum/display/149477/articles/offshore/volume-62/issue-6/departments/drilling-production/new-tool-addresses-ecd-problem.html, pp. 1-3.

P.A. Bern, et al., A New Downhole Tool for ECD Reduction, Feb. 19, 2003, pp. 1-4, SPE/IADC 79821, Society of Petroleum Engineers Inc., U.S.A.

Sven Krüger, TurboLift Advanced ECD Control, Apr. 2005, pp. 1-13, Baker Hughes Incorporated/INTEQ, U.S.A.

* cited by examiner

JUNK BASKET WITH SELF CLEAN ASSEMBLY AND METHODS OF USING SAME

BACKGROUND

1. Field of Invention

The invention is directed to a downhole clean-up tool for use in oil and gas wells, and in particular, to a downhole clean-up tool that is capable of self-cleaning debris out of the flow path so that the tool can continue to operate for a longer period of time.

2. Description of Art

Downhole tools for clean-up of debris in a wellbore are generally known and are referred to as "junk baskets." In general, the junk baskets have a screen or other structure that catches debris within the tool as fluid flows through the tool. This occurs because the fluid carrying the debris flows through the tool such that at a point in the flow path, the speed of the fluid flowing through the tool decreases such that the junk or debris falls out of the flow path and into a basket.

SUMMARY OF INVENTION

Broadly, downhole tools for clean-up of debris within a well comprise a screen member in sliding engagement with an inner wall surface of a housing or mandrel. As the screen member becomes blocked, it moves from a first or initial position to a second or actuated position which causes a pressure change detectable at the surface of the wellbore. The pressure change causes the debris blocking fluid flow through the screen member to fall off the screen member thereby allowing an increase in fluid flow through the screen member. As a result, the screen member returns to its initial position and fluid again flows through the screen member for capturing by the screen member.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
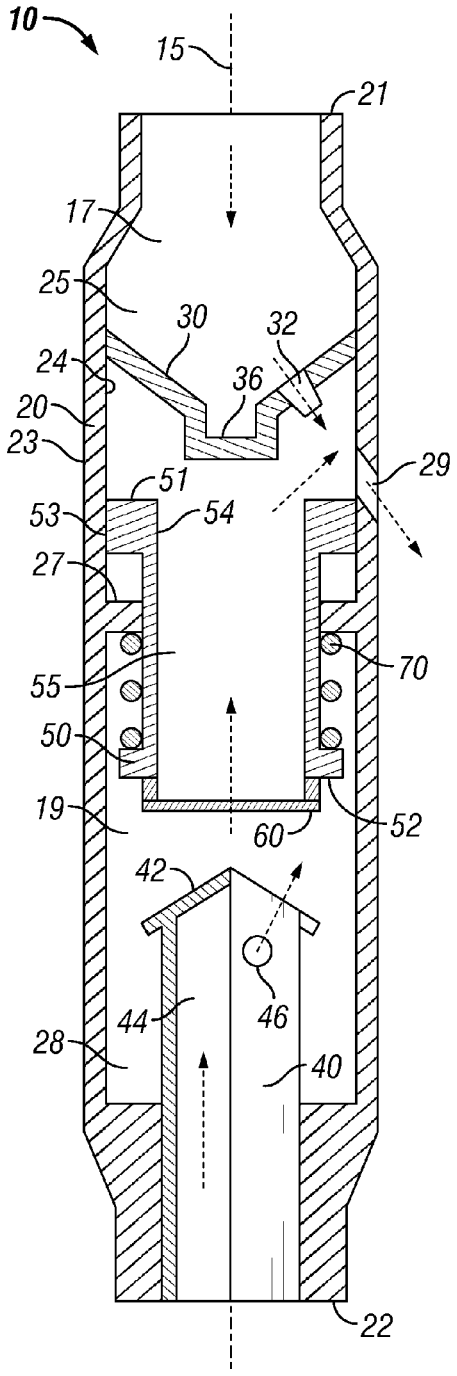
FIG. 1 is a partial cross-sectional view of a specific embodiment of a downhole tool disclosed herein shown in an initial position.
Figure 2:
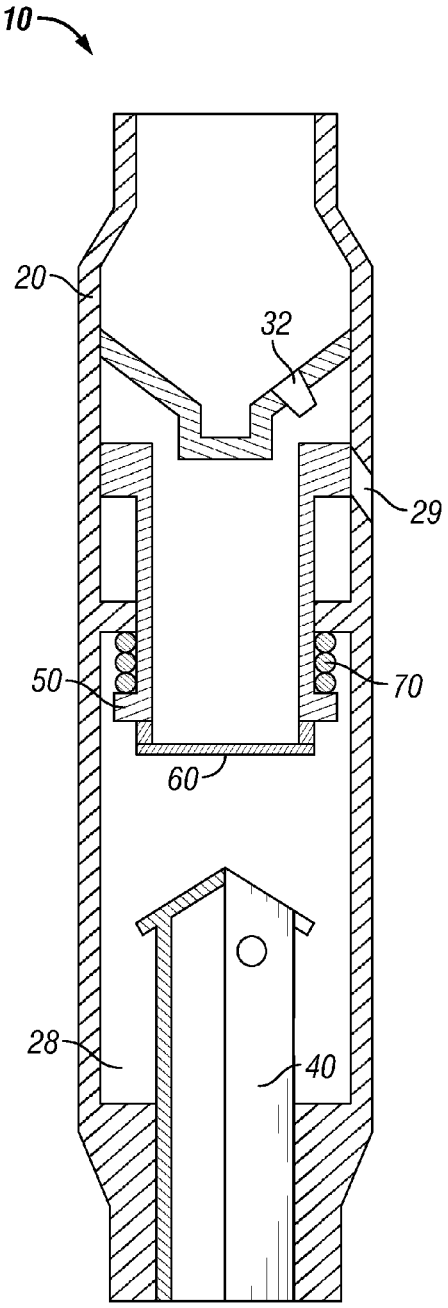
FIG. 2 is a partial cross-sectional view of the downhole tool of FIG. 1 shown in an actuated position.

Referring now to FIGS. 1-2, in one particular embodiment, downhole tool 10 comprises mandrel or housing 20 having upper end 21, lower end 22, outer wall surface 23, and inner wall surface 24 defining bore 25. Disposed along a portion of inner wall surface 23 is shoulder or flange 27. One or more ports 29 are disposed through mandrel 20 in fluid communication with outer wall surface 23 and inner wall surface 24 and, thus bore 25. As shown in FIGS. 1-2, port 29 is disposed at a downward angle. It is to be understood, however, that port 29 is not required to be disposed in this manner. Instead, port 29 can be angled upward or be disposed perpendicular to bore 25.

Toward upper end 21 of mandrel 20 is partition 30 which divides bore 25 into upper 17 bore and lower bore 19. As shown in FIGS. 1-2, partition 30 is angled downward and includes a centrally located downward protrusion 36. Disposed within partition 30 is one or more ports 32. One or more or all of ports 32 can have a shape or device disposed therein that accelerates fluid flowing through port(s) 32 in the direction indicated by the arrow in FIG. 1. Port(s) 32 can be disposed parallel to or at an angle relative to longitudinal axis 15 of mandrel 20. As shown in FIGS. 1-2, port 32 is disposed at an angle relative to longitudinal axis 15.

Figure 3:
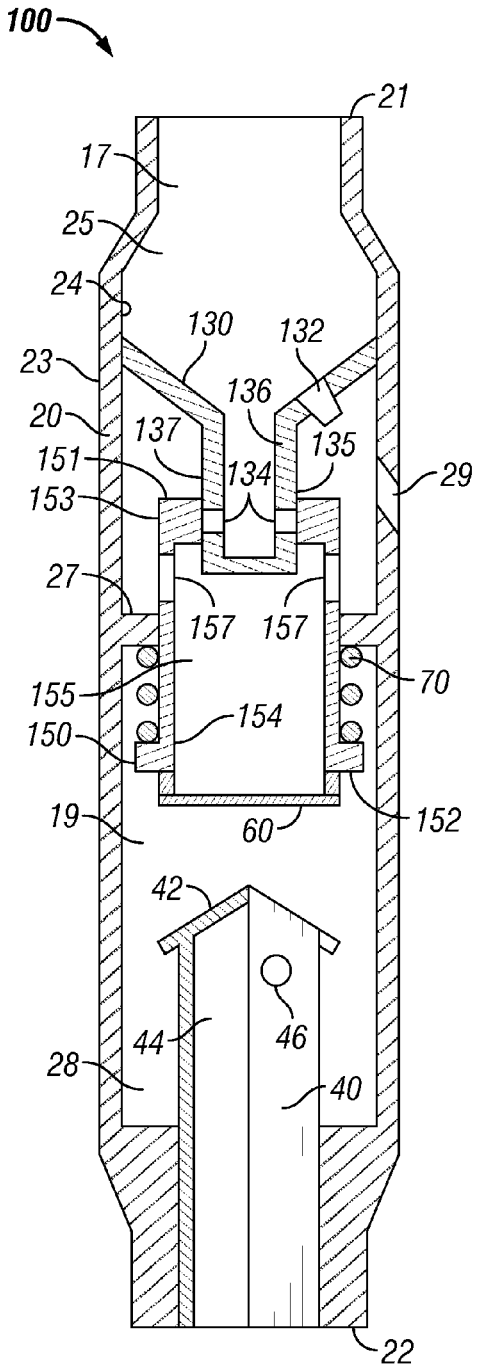
FIG. 3 is a partial cross-sectional view of another specific embodiment of a downhole tool disclosed herein shown in an initial position.

Further, as shown in FIGS. 1-3, port 32 is in alignment with port 29 in mandrel 20. It is to be understood, however, that port 32 is not required to be in alignment with port 29. In addition, it is to be understood that in the embodiments in which more than one port 29 is disposed in mandrel 20, not all of the ports 29 are required to be in alignment with a corresponding port 32. However, in a preferred embodiment, partition 30 has more than one port 32 each of which is disposed at an angle relative to longitudinal axis 15 and each of which is in alignment with a corresponding port 29 disposed in mandrel 20.

Disposed at lower end 22 of mandrel 20 is debris deflector member 40 having a closed upper end 42, bore 44, and opening 46. Debris deflector members such as debris deflector member 40 are known in the art. In general, fluid carrying pieces of debris is carried upward through bore 44 as indicated by the arrow in FIG. 1. Large pieces of debris are unable to pass through opening 46 and, therefore, the large pieces of debris contact upper end 42 and are directed downward, usually into a basket or cavity (not shown) disposed in fluid communication with bore 44. Meanwhile, the fluid, together with any debris capable of passing through opening 46, exits opening 46 and enters lower portion 19 of bore 25.

Disposed in sliding engagement with flange 27 and inner wall surface 24 of mandrel 20 is sleeve 50. Sleeve 50 comprises upper end 51, lower end 52, outer wall surface 53, a portion of which is in sliding engagement with flange 27 and a portion of which is in sliding engagement with inner wall surface 24, and inner wall surface 54 defining bore 55. Affixed to lower end 52 of sleeve 50 is screen member 60. Screen member 60 can be any type of screen member known in the art. In general, screen member 60 includes one more apertures through which fluid is permitted to pass, yet larger debris is prevented from passing. As a result, the debris that is unable to pass through screen member 60 either falls off of screen into cavity 28 partially defined by inner wall surface 24 of mandrel 20 and an outer wall surface of debris deflector member 40, or becomes stuck on screen member 60.

As shown in FIG. 1, sleeve 50 is in an initial position and, as shown in FIG. 2, sleeve 50 is disposed in an actuated position. Operatively associated with sleeve 50 is return member 70. Return member 70 can be any device known in the art that is capable returning sleeve 50 toward an initial position. In the embodiment of FIGS. 1-2, return member 70 comprises a coiled spring operatively associated with flange 27 and a flange disposed on outer wall surface 53 of sleeve 50.

In operation, downhole tool 10 is included as part of a tubing or work string (not shown) that is then disposed within a wellbore (not shown). Conventional fluid circulation down through the work string is utilized to perform a reverse circulating action downhole to collect debris such as metal cuttings and other junk. The circulation of fluid through the work string flows debris upward through bore 44 of debris deflector member 40. In so doing, larger pieces of debris unable to pass through opening 46 are captured within a basket or cavity (not shown) in fluid communication with bore 44. The fluid and smaller pieces of debris capable of passing through opening 46 flow into lower portion 19 of mandrel 20 (see arrow in FIG. 1). The fluid then passes through screen member 60 (see arrow in FIG. 1) where a portion of the smaller debris is captured by screen member 60. Some of this smaller debris falls off of screen member 60 into cavity 28, while other pieces of the smaller debris become trapped or attached to screen member 60.

To facilitate pulling the fluid up through bore 44 of debris deflector member 40 and, thus, through screen member 60, fluid is flowed down the work string to which downhole tool 10 is attached and into upper portion 17 of bore 25 of mandrel 20. This fluid is restricted from flowing into lower portion 19 of bore 25 by partition 30. Some of this fluid, however, is permitted to flow through partition 30 by flowing through port 32. In certain embodiments, port 32 accelerates the flow of the fluid to create a pressure differential between the fluid flowing out of port 32 and the fluid passing through screen member 60. In the embodiment of FIGS. 1-2, port 32 is in alignment with port 29 which facilitates creation of the pressure differential.

As noted above, as the fluid is flowed upward through debris deflector 40, into lower portion 19 of bore 25 below screen member 60, and then through screen member 60, some debris becomes attached or trapped against screen member 60, thereby decreasing the efficacy of screen member 60 to remove debris from the fluid passing through screen member 60. As a result, the upper flowing fluid below screen member 60, facilitated by the fluid flowing out of port 32 and through port 29, causes sleeve 40 to move from the initial position (FIG. 1) toward the actuated position (FIG. 2). In doing so, a portion of upper end 51 blocks at least a portion of port 29 and return member 70 becomes energized. Upon port 29 being at least partially blocked by sleeve 50, a pressure spike or increase is observed by an operator at the surface of the well which indicates that fluid flow through screen member 60 is at least partially blocked by debris.

In addition, the pressure differential caused by the fluid flowing through port 32 is lessened and such fluid is redirected downward toward screen member 60. As a result, the pressure of the fluid flowing upward toward screen member 60 is no longer strong enough to push the attached or trapped debris into screen member 60 and, therefore, the debris attached or trapped in screen member 60 falls away and into cavity 28. Upon a sufficient amount of the attached/trapped debris being removed from screen member 60, return member 70 releases its stored energy and returns sleeve 50 toward the initial position. Consequently, port 29 is no longer blocked and debris clean-up operations can proceed until either all debris is removed from the wellbore, or the cavities of downhole tool 10 are filled. At that time, the work string, including downhole tool 10 together with all debris captured within downhole tool 10 or within another portion of the work string, can be retrieved from the wellbore.

Figure 4:
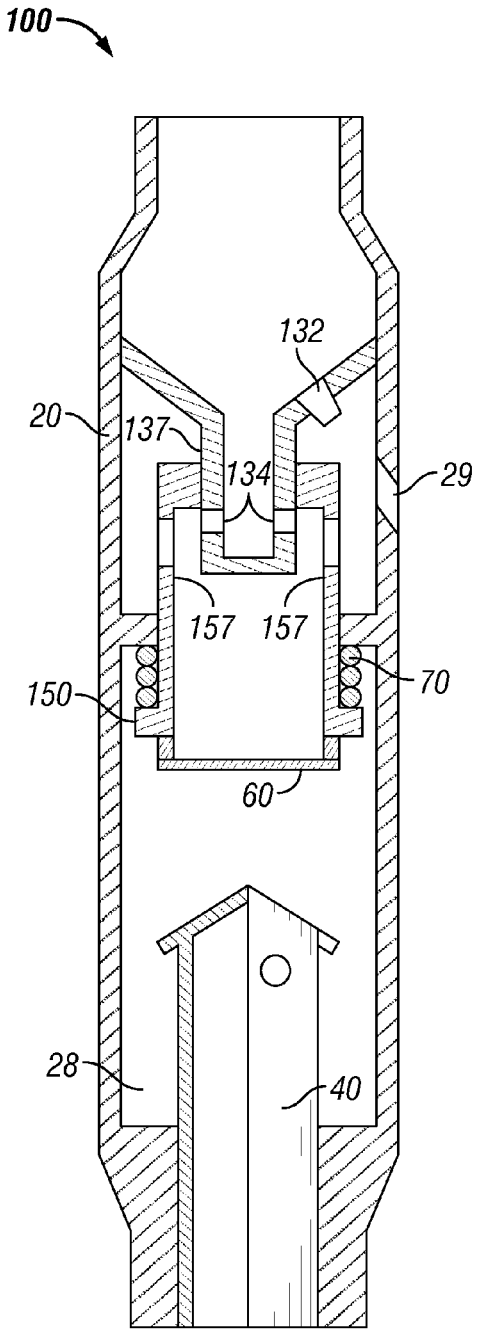
FIG. 4 is a partial cross-sectional view of the downhole tool of FIG. 3 shown in an actuated position.

Referring now to FIGS. 3-4, in another embodiment, downhole tool 100 includes mandrel 20, debris deflector member 40, screen member 60, and return member 70 that are identical to the embodiments of FIGS. 1-2 and, therefore, use like reference numerals in this embodiment. Downhole tool 100, however, includes partition 130 that divides bore 25 into upper bore 17 and lower bore 19 and includes one or more bypass ports 134 disposed in wall 135 of centrally located downward protrusion 136. As with the embodiments of FIGS. 1-2, partition 130 includes one or more ports 132 and, one or more of ports 132 can include a shape or device inserted in port(s) 132 that accelerates fluid as it flows through port(s) 132.

Disposed in sliding engagement with flange 27 and outer wall surface 137 of wall 135 is sleeve 150. Sleeve 150 comprises upper end 151, lower end 152, outer wall surface 153, a portion of which is in sliding engagement with flange 27, and inner wall surface 154 defining bore 155. A portion of inner wall surface 154 at upper end 151 is in sliding engagement with outer wall surface 137. Disposed through outer wall surface 153 and inner wall surface 154 and in fluid communication with bore 155 are ports 157. Affixed to lower end 152 of sleeve 150 is screen member 60.

As shown in FIG. 3, sleeve 150 is in an initial position and, as shown in FIG. 4, sleeve 150 is disposed in an actuated position. In the initial position, ports 134 of partition 130 are at least partially blocked by a portion of sleeve 150. Operatively associated with sleeve 150 is return member 70. As with the embodiments of FIGS. 1-2, return member 70 can be any device known in the art that is capable returning sleeve 150 toward an initial position. In the embodiment of FIGS. 3-4, return member 70 comprises a coiled spring operatively associated with flange 27 and a flange disposed on outer wall surface 153 of sleeve 150.

In general, downhole tool 100 operates in a similar manner as the operation of the embodiments of FIGS. 1-2 discussed above. The main difference is that, when sleeve 150 is in the initial position, the fluid flowing through screen member 60 enters into bore 155 and then exists ports 157 before flowing out of port(s) 29. In addition, when sufficient debris becomes trapped or attached to screen member 60, sleeve 150 moves upwards to unblock ports 134 in partition 130 and return member 70 becomes energized (FIG. 4). In addition, in certain embodiments, all or a portion of port(s) 29 are blocked by a portion of sleeve 150. Upon ports 134 becoming unblocked or opened, a pressure drop is observed by the operator at the surface to indicate that fluid flow through screen member 60 has become blocked. In addition, the pressure differential created by the fluid flowing through port 132 is lessened, thereby allowing some of the debris attached to or trapped in screen member 60 to fall away and into cavity 28.

Upon a sufficient amount of the attached/trapped debris being removed from screen member 60, return member 70 releases its stored energy and returns sleeve 150 toward the initial position. Consequently, ports 134 become blocked and, in certain embodiments, port 29 is no longer blocked, so that debris clean-up operations can proceed until either all debris is removed from the wellbore, or the cavities of downhole tool 100 are filled. At that time, the work string, including downhole tool 100 together with all debris captured within downhole tool 100 or within another portion of the work string, can be retrieved from the wellbore.

Figure 5:
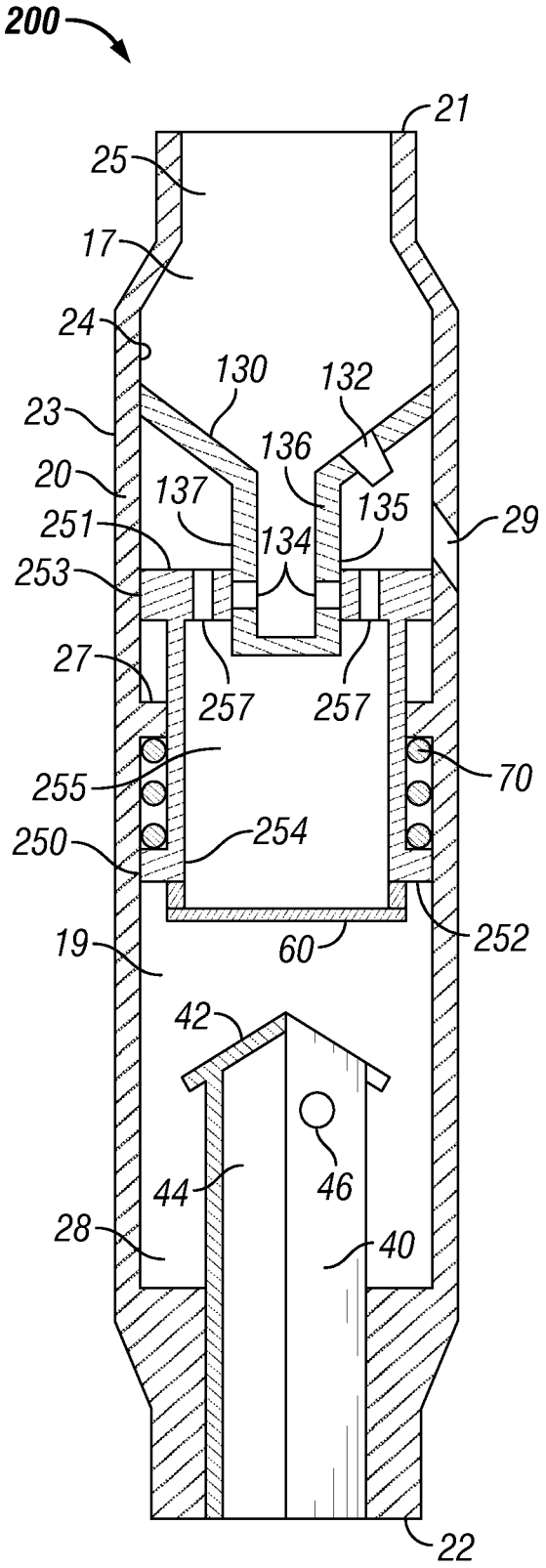
FIG. 5 is a partial cross-sectional view of an additional specific embodiment of a downhole tool disclosed herein shown in an initial position.

As illustrated in FIG. 5, an additional embodiment of downhole tool 200 includes mandrel 20, debris deflector member 40, screen member 60, and return member 70 that are identical to the embodiments of FIGS. 1-4 and, therefore, use like reference numerals in this embodiment. In addition, downhole tool 200 includes a partition 130 that is identical to partition 130 in the embodiments of FIGS. 3-4 and, therefore, uses like reference numerals in this embodiment. In the embodiment of FIG. 5, however, downhole tool 200 includes sleeve 250 disposed in sliding engagement with flange 27, inner wall surface 24, and outer wall surface 137 of wall 135.

Sleeve 250 comprises upper end 251, lower end 252, outer wall surface 253, a portion of which is in sliding engagement with flange 27 and a portion of which is in sliding engagement with inner wall surface 24, and inner wall surface 254 defining bore 255. A portion of inner wall surface 154 at upper end 151 is in sliding engagement with outer wall surface 137. Disposed through upper end 151 in fluid communication with bore 255 are ports 257. Affixed to lower end 252 of sleeve 250 is screen member 60.

As shown in FIG. 5, sleeve 250 is in an initial position. The actuated position of sleeve 250 is not shown. In the initial position, ports 134 of partition 130 are at least partially blocked by a portion of sleeve 250. Operatively associated with sleeve 250 is return member 70. As with the embodiments of FIGS. 1-4, return member 70 can be any device known in the art that is capable returning sleeve 250 toward the initial position (FIG. 5). In the embodiment of FIG. 5, return member 70 comprises a coiled spring operatively associated with flange 27 and a flange disposed on outer wall surface 253 of sleeve 250.

In general, downhole tool 200 operates in a similar manner as the operation of the embodiments of FIGS. 1-4 discussed above. The main difference is that, when sleeve 250 is in the initial position, the fluid flowing through screen member 60 enters into bore 255 and then exists ports 257 disposed in upper end 252 before flowing out of port(s) 29. In addition, when sufficient debris becomes trapped or attached to screen member 60, sleeve 250 moves upwards to unblock ports 134 in partition 130 and return member 70 becomes energized. In addition, in certain embodiments, all or a portion of port(s) 29 are blocked by a portion of sleeve 250. Upon ports 134 becoming unblocked or opened, a pressure drop is observed by the operator at the surface to indicate that fluid flow through screen member 60 has become blocked. In addition, the pressure differential created by the fluid flowing through port 132 is lessened, thereby allowing some of the debris attached to or trapped in screen member 60 to fall away and into cavity 28.

Upon a sufficient amount of the attached/trapped debris being removed from screen member 60, return member 70 releases its stored energy and returns sleeve 250 toward the initial position. Consequently, ports 134 become blocked and, in certain embodiments, port 29 is no longer blocked, so that debris clean-up operations can proceed until either all debris is removed from the wellbore, or the cavities of downhole tool 200 are filled. At that time, the work string, including downhole tool 200 together with all debris captured within downhole tool 200 or within another portion of the work string, can be retrieved from the wellbore.

It is to be understood that the invention is not limited to the exact details of construction, operation, exact materials, or embodiments shown and described, as modifications and equivalents will be apparent to one skilled in the art. For example, each of the ports of the mandrel, partition, and sleeve can have any shape desired or necessary to facilitate operation of the downhole tools disclosed herein. Further, a nozzle or other device can be placed within the port(s) of the partition to increase the velocity of the incoming fluid as it flows through the ports. In addition, the partition is not required to include a central elongated extension or be angled as shown in the Figures. Moreover, the apertures in screen member can have any arrangement, size and dimensions as desired or necessary to restrict flow of debris through screen and to allow debris stuck on the screen member to be removed. Additionally, the return member is not required to be a coiled spring. Instead, the return member can comprise a compressible elastomeric device, a Bellville washer, and or the like. Further, one or more seals can be disposed along one or both of the outer wall surface of the sleeve, the inner wall surface of the mandrel, or along the flange disposed on the inner wall surface of the mandrel to isolate one or more areas. Moreover, the number, size, location, and orientation of the ports in the mandrel, partition, or sleeve can be modified as desired or necessary to facilitate the downhole tools disclosed herein operating as disclosed herein.

Further, it is to be understood that the term "wellbore" as used herein includes open-hole, cased, or any other type of wellbores. In addition, the use of the term "well" is to be understood to have the same meaning as "wellbore." Moreover, in all of the embodiments discussed herein, upward, toward the surface of the well (not shown), is toward the top of Figures, and downward or downhole (the direction going away from the surface of the well) is toward the bottom of the Figures. However, it is to be understood that the tools may have their positions rotated in either direction any number of degrees. Accordingly, the tools can be used in any number of orientations easily determinable and adaptable to persons of ordinary skill in the art. Accordingly, the invention is therefore to be limited only by the scope of the appended claims.

What is claimed is:

1. A downhole tool for capturing debris flowing through the downhole tool, the downhole tool comprising:

a mandrel having a mandrel upper end, a mandrel lower end, a mandrel outer wall surface, a mandrel inner wall surface defining a mandrel bore, and a mandrel port disposed between the mandrel outer wall surface and the mandrel inner wall surface and in fluid communication with the mandrel bore;

a partition disposed in the mandrel bore above the mandrel port, the partition dividing the mandrel bore into an upper bore and a lower bore, and having at least one partition port disposed there-through in fluid communication with the upper bore and the lower bore;

a sleeve member disposed in the lower bore and operatively associated with the inner wall surface of the mandrel bore, the sleeve having a first position, a second position, a sleeve upper end, a sleeve lower end, a sleeve outer wall surface, and a sleeve inner wall surface defining a sleeve bore; and a screen member affixed to the sleeve lower end, the screen member restricting fluid flow through the sleeve bore, wherein the sleeve member moves from the first position toward the second position due to a reduction in fluid flow through the screen member.

2. The downhole tool of claim 1, wherein the partition port accelerates a flow of a fluid flowing through the partition port.

3. The downhole tool of claim 1, wherein the partition port is in alignment with the mandrel port.

4. The downhole tool of claim 1, wherein the sleeve member is operatively associated with the inner wall surface of the mandrel bore by a portion of the sleeve outer wall surface toward the sleeve upper end being in sliding engagement with the mandrel inner wall surface, and wherein the mandrel port being opened when the sleeve is in the first position and the mandrel port being at least partially blocked when in the second position.

5. The downhole tool of claim 4, wherein the partition port accelerates a flow of a fluid flowing through the partition port and is in alignment with the mandrel port.

6. The downhole tool of claim 5, further comprising a return member operatively associated with the sleeve.

7. The downhole tool of claim 1, wherein the sleeve member is operatively associated with the inner wall surface of the bore by a portion of the mandrel inner wall surface being in sliding engagement with the sleeve outer wall surface.

8. The downhole tool of claim 1, wherein a portion of the sleeve inner wall surface is in sliding engagement with an extension disposed on the partition, the extension having a bypass port disposed there-through in fluid communication with the upper bore and the lower bore, the bypass port being at least partially blocked when the sleeve is in the first position and being at least partially opened when the sleeve is in the second position.

9. The downhole tool of claim 8, wherein the sleeve further comprises a sleeve port disposed in the sleeve outer wall surface and the sleeve inner wall surface and in fluid communication with the sleeve bore.

10. The downhole tool of claim 9, further comprising a return member operatively associated with the sleeve.

11. The downhole tool of claim 8, wherein the partition port accelerates a flow of a fluid flowing through the partition port.

12. The downhole tool of claim 11, wherein the partition port is in alignment with the mandrel port.

13. The downhole tool of claim 8, wherein the sleeve further comprises a sleeve port disposed in the sleeve upper end and in fluid communication with the sleeve bore and the lower bore of the mandrel.

14. The downhole tool of claim 13, wherein the sleeve member is operatively associated with the inner wall surface of the bore by a portion of the sleeve outer wall surface toward the sleeve upper end being in sliding engagement with the mandrel inner wall surface, and wherein the mandrel port is opened when the sleeve is in the first position and the mandrel port being at least partially blocked when in the second position.

15. The downhole tool of claim 14, further comprising a return member operatively associated with the sleeve.

16. A method of removing debris from a fluid flowing through a downhole tool, the method comprising the steps of:

(a) pumping a first fluid into an upper bore of a downhole tool and flowing the first fluid through a port disposed in a partition dividing the upper bore from a lower bore of the downhole tool and out of a mandrel port disposed in a wall of the downhole tool;

(b) during step (a), flowing a debris laden fluid into the lower bore of the downhole tool, the debris laden fluid comprising debris; and (c) passing the debris laden fluid through a screen disposed in the lower bore of the downhole tool, the screen being affixed to a slidable sleeve having a first position and a second position, the sleeve moving from the first position toward the second position due to a reduction in a flow rate of the debris laden fluid through the screen, wherein reduction in the flow rate of the debris laden fluid through the screen is caused by an accumulation of debris on the screen, and wherein at least a portion of the accumulation of debris on the screen is removed by altering a pressure differential between the mandrel port and the screen due to the movement of the sleeve from the first position to the second position.

17. The method of claim 16, wherein during removal of the accumulation of debris on the screen, at least a portion of the mandrel port is blocked.

18. The method of claim 16, wherein a pressure of the first fluid flowing through the port in the partition is increased when the sleeve is moved from the first position toward the second position.

19. The method of claim 16, wherein a pressure of the first fluid flowing through the port in the partition is decreased when the sleeve is moved from the first position toward the second position.

20. The method of claim 19, wherein the sleeve at least partially opens a bypass port disposed in the partition when the sleeve is moved from the first position toward the second position.

* * * * *